US010767126B2

(12) United States Patent
Dequenne et al.

(10) Patent No.: US 10,767,126 B2
(45) Date of Patent: Sep. 8, 2020

(54) COMBINATION OF FUEL ADDITIVES

(71) Applicant: TOTAL MARKETING SERVICES, Puteaux (FR)

(72) Inventors: Bernard Dequenne, Ecully (FR); Thomas Dubois, Lyons (FR)

(73) Assignee: TOTAL MARKETING SERVICES, Puteaux (FR)

( * ) Notice: Subject to any disclaimer, the term of this patent is extended or adjusted under 35 U.S.C. 154(b) by 0 days.

(21) Appl. No.: 16/343,982

(22) PCT Filed: Oct. 20, 2017

(86) PCT No.: PCT/FR2017/052882
§ 371 (c)(1),
(2) Date: Apr. 22, 2019

(87) PCT Pub. No.: WO2018/073544
PCT Pub. Date: Apr. 26, 2018

(65) Prior Publication Data

US 2019/0330549 A1 Oct. 31, 2019

(30) Foreign Application Priority Data

Oct. 21, 2016 (FR) ..... 16 60208
Oct. 21, 2016 (RU) ..... 2016141391

(51) Int. Cl.

| | |
|---|---|
| ***C10L 1/14*** | (2006.01) |
| ***C10L 1/19*** | (2006.01) |
| ***C10L 1/198*** | (2006.01) |
| ***C10L 1/222*** | (2006.01) |
| ***C10L 1/224*** | (2006.01) |
| ***C10L 10/14*** | (2006.01) |
| ***C10L 10/18*** | (2006.01) |

(52) U.S. Cl.
CPC ..... *C10L 1/143* (2013.01); *C10L 1/191* (2013.01); *C10L 1/1985* (2013.01); *C10L 1/224* (2013.01); *C10L 1/2222* (2013.01); *C10L 10/14* (2013.01); *C10L 10/18* (2013.01); *C10L 2270/026* (2013.01)

(58) Field of Classification Search
CPC ..... C10L 1/143; C10L 1/191; C10L 1/1985; C10L 1/2222; C10L 1/224; C10L 10/14; C10L 10/18; C10L 2270/026
See application file for complete search history.

(56) References Cited

U.S. PATENT DOCUMENTS

| | | | | |
|---|---|---|---|---|
| 2,952,969 | A | 9/1960 | Wasserbach et al. | |
| 3,048,479 | A | 8/1962 | Ilnyckyj et al. | |
| 3,230,058 | A * | 1/1966 | Walters | C10L 1/143 44/419 |
| 3,361,673 | A | 1/1968 | Stuart et al. | |
| 3,401,118 | A | 9/1968 | Benoit et al. | |
| 3,578,422 | A * | 5/1971 | Dorer, Jr. | C10L 1/143 44/331 |
| 3,627,838 | A | 12/1971 | Ilnyckyj et al. | |
| 3,717,446 | A | 2/1973 | Howland et al. | |
| 3,790,359 | A | 2/1974 | Feldman | |
| 3,961,961 | A | 6/1976 | Rich | |
| 4,171,959 | A | 10/1979 | Vartanian | |
| 4,234,435 | A | 11/1980 | Meinhardt et al. | |
| 4,511,369 | A | 4/1985 | Denis et al. | |
| 4,661,120 | A | 4/1987 | Carr et al. | |
| 4,664,676 | A | 5/1987 | Denis et al. | |
| 4,900,332 | A | 2/1990 | Denis et al. | |
| 7,182,797 | B2 * | 2/2007 | Mekonen | C10L 1/143 44/389 |
| 9,587,193 | B2 * | 3/2017 | Arondel | C10L 10/04 |
| 2012/0210966 | A1 | 8/2012 | Wager et al. | |
| 2013/0104826 | A1 | 5/2013 | Burgess et al. | |
| 2015/0315506 | A1 | 11/2015 | Dubois | |
| 2016/0024411 | A1 | 1/2016 | Arondel et al. | |

(Continued)

FOREIGN PATENT DOCUMENTS

| | | |
|---|---|---|
| EP | 0 261 957 A2 | 3/1988 |
| EP | 0 271 385 A1 | 6/1988 |
| EP | 0 758 015 A1 | 2/1997 |
| FR | 2 528 423 A1 | 12/1983 |
| GB | 2 071 140 A | 9/1981 |
| GB | 2 121 808 A | 1/1984 |

(Continued)

OTHER PUBLICATIONS

Arondel et al., "Evaluating Injector Fouling in Direct Injection Spark Ignition Engines". Technische Akademie Esslingen par Techn. 5 Akad. Esslingen, Ostfildern, 2015, 10th international colloquium, p. 375-386.

(Continued)

*Primary Examiner* — Cephia D Toomer
(74) *Attorney, Agent, or Firm* — Oliff PLC

(57) ABSTRACT

A fuel composition which includes at least: a fuel from one or more sources selected from the group that comprises mineral, plant and synthetic sources; a compound (T1) selected among polyalkylene glycols, C1-C12 alkyl and polyalkylene glycol ethers, and the mixtures thereof; and a compound (T2) selected among the non-ionic emulsifiers. Also, an additive composition including at least: a compound (T1) selected among the C1-C6 alkyl and polyethylene glycol ethers including two to six units of ethylene glycol; a compound (T2) selected among the esters of one or more C1-C36 alkenyl carboxylic or alkyl carboxylic acids, and a polyol selected among sorbitan and isosorbide, taken alone or mixed together; and possibly a detergent additive. Further, a method for preventing, avoiding or delaying the formation of ice crystals or flakes in a tank of a vehicle provided with an internal combustion engine.

19 Claims, No Drawings

(56) References Cited

U.S. PATENT DOCUMENTS

| | | | |
|---|---|---|---|
| 2016/0152910 | A1 | 6/2016 | Reid et al. |
| 2017/0247624 | A1 | 8/2017 | Papin et al. |

FOREIGN PATENT DOCUMENTS

| | | | |
|---|---|---|---|
| WO | 92/15623 | A1 | 9/1992 |
| WO | 2006/135881 | A2 | 12/2006 |

OTHER PUBLICATIONS

Dec. 8, 2017 Written Opinion issued in International Patent Application No. PCT/FR2017/052882.
Dec. 8, 2017 Search Report issued in International Patent Application No. PCT/FR2017/052882.

* cited by examiner

COMBINATION OF FUEL ADDITIVES

The present invention relates to a combination of fuel additives that is capable of preventing the crystallization of water, in particular the formation of ice flakes, at low temperature. It also relates to a process for avoiding the formation of ice crystals in a fuel at low temperature.

PRIOR ART

Motor fuels, in particular diesel fuels (including biodiesel), naturally incorporate up to 300 ppm of water. Under extremely cold conditions (for example in Russia) and depending on the temperature cycles and changes, this water may crystallize and form relatively large flakes in suspension. These flakes may adversely affect the quality of the fuel and, in particular, may lead to filter plugging problems.

The liquid fuels of internal combustion engines contain components that may degrade during the operation of the engine. The problem of deposits in the internal parts of combustion engines is well known to motorists. Additives referred to as detergents used in the fuels are used to keep the engine clean by limiting deposits ("keep-clean" effect) or by reducing the deposits already present in the internal parts of the combustion engine ("clean-up" effect). The presence of deposits may impair the performance of the combustion, in particular increasing polluting emissions and the emissions of particulates. Other consequences of the excessive presence of deposits have been reported in the literature, such as the increase in fuel consumption and drivability (or engine operation) problems. The prevention and reduction of deposits in these new engines are essential for an optimal operation of engines today.

It was observed that the addition of so-called performance additives such as detergents and/or demulsifiers greatly exacerbates the problem of formation of ice flakes at low temperature.

The technical problem solved by the invention consists in providing a composition of fuel additives that makes it possible to prevent or avoid the formation of flakes while maintaining the properties of the fuel, in particular when the fuel is additized with a detergent additive intended to guarantee the cleanliness of the engine.

One of the existing solutions for avoiding the formation of flakes at low temperature consists in selecting fuels containing a very low water content. Water separation units exist in petroleum plants that make it possible to obtain fuels that are virtually water-free. However, depending on the country and the logistical constraints, this solution is not always possible.

Some specific fuels such as the fuels used in aviation are treated with deicing agents, such as diethylene glycol methyl ether (DIEGME) or ethylene glycol methyl ether (EGME). These additives are added to the fuels used in aviation to prevent the formation of ice crystals that could adversely affect the correct operation of the members of the fuel circuit of an aircraft at low temperature (filters, pumps and valves).

However, these deicing agents are expensive and it is desired to be able to use them in a lesser amount while preserving the technical effect.

The other deicing agents known for lowering the freezing point of water in a fuel are alcohols. Yet the addition of these agents adversely affects the properties of the fuel, in particular when the fuel is additized with a detergent. In this case, an inhibition of the detergent properties of the fuel is observed.

GB 2 071 140 discloses the use of methanol, 2-methoxyethanol and/or glycol ether type compounds as deicing agents for fuel for internal combustion engines, and in particular for diesel engines.

U.S. Pat. No. 4,661,120 discloses additized diesel fuels having improved low-temperature properties. The additized fuels comprise (a) an agent that acts on the formation of wax crystals, (b) a deposit dispersant/stabilizer, (c) a hydrocarbon-based solvent and (d) an aqueous solvent comprising a compound having —$CH_2CH_2O$— units.

U.S. Pat. No. 2,952,969 discloses the use of glycol ester type compounds as deicing agents for the fuels used in aviation.

U.S. Pat. No. 3,717,446 describes the use of the combination of two surfactants and a lubricating oil as a deicing agent and detergent additive in fuels.

The objective of the invention was therefore to find additives that make it possible to prevent water from freezing in the form of crystals in a fuel, in particular in a diesel fuel, these additives being compatible with the use of detergent additives for maintaining the cleanliness of the engine.

Compositions of additives were also sought, the cost of which is lower than that of DIEGME and EGME while having performances of a comparable level.

SUMMARY OF THE INVENTION

The invention is based on the combination of a polyalkylene glycol compound (T1) optionally functionalized at the chain end with an alkyl group and of at least one nonionic surfactant such as a polyol fatty acid ester (T2). This combination of additives makes it possible, surprisingly, to avoid the formation of ice flakes in a fuel at a temperature less than or equal to −15° C., or even less than or equal to −25° C., or even less than or equal to −30° C. This property is observed with reduced amounts of polyalkylene glycol compound, and therefore with a reduced raw material cost relative to a polyalkylene glycol alone, while retaining high performances of resistance to the formation of ice crystals.

One subject of the invention is a fuel composition which comprises at least:

- a fuel derived from one or more sources selected from the group consisting of mineral, animal, vegetable and synthetic sources,
- a compound (T1) selected from: polyalkylene glycols, $C_1$-$C_{12}$ alkyl ethers of polyalkylene glycol, and mixtures thereof,
- a compound (T2) selected from nonionic emulsifiers.

According to one preferred embodiment, the fuel comprises at least 50% by weight of a diesel fuel, preferably at least 70% by weight, more preferentially at least 90% by weight, relative to the total weight of fuel, more preferentially still the fuel consists of diesel fuel.

According to one preferred embodiment, the fuel comprises at least 50 ppm of water, preferably at least 100 ppm, more preferentially still at least 150 ppm.

According to one preferred embodiment, the compound (T1) is selected from polyethylene glycols, $C_1$-$C_{12}$ alkyl ethers of polyethylene glycol, and mixtures thereof.

According to one more preferred embodiment, the compound (T1) is selected from $C_1$-$C_6$ alkyl ethers of polyethylene glycol comprising two to six ethylene glycol units, preferably diethylene glycol methyl ether.

According to one preferred embodiment, the compound (T2) is selected from polyol esters of saturated or unsaturated, linear or branched, cyclic or acyclic $C_1$ to $C_{36}$, preferably $C_4$ to $C_{30}$ monocarboxylic aliphatic hydrocarbons, it being possible for said esters to be taken alone or as a mixture.

According to one more preferred embodiment, the compound (T2) is obtained by esterification between:

one or more $C_1$ to $C_{36}$, preferably $C_4$ to $C_{30}$ alkylcarboxylic or alkenylcarboxylic acids, optionally comprising one or more ethylenic bonds; and a linear or branched, cyclic or acyclic $C_4$-$C_{20}$ polyol optionally comprising one or more heterocycles with 5 to 6 atoms, preferably one or two heterocycles with 4 to 5 carbon atoms and an oxygen atom.

According to one more preferred embodiment, the alkylcarboxylic and alkenylcarboxylic acids are selected from the group consisting of stearic, isostearic, linolenic, oleic, linoleic, behenic, arachidonic, ricinoleic, palmitic, myristic, lauric, capric acids, taken alone or as a mixture.

According to one preferred embodiment, the polyol is selected from oxygenated $C_4$-$C_{20}$ hydrocarbon-based molecules comprising at least two, preferably at least three hydroxyl functions.

According to one preferred embodiment, the polyol is selected from the group consisting of erythritol, xylitol, arabitol, ribitol, sorbitol, maltitol, isomaltitol, lactitol, volemitol, mannitol, pentaerythritol, 2-hydroxymethyl-1,3-propanediol, 1,1,1-tri(hydroxymethyl)ethane, trimethylolpropane, sorbitan, isosorbide, and carbohydrates such as saccharose, fructose, maltose and glucose.

According to one preferred embodiment, the compound (T2) is selected from sorbitan esters and isosorbide esters, preferably from sorbitan monoesters, diesters and triesters and isosorbide monoesters and diesters, taken alone or as a mixture.

According to one more preferred embodiment, the compound (T2) is selected from mixtures of sorbitan partial esters, preferably mixtures of sorbitan monooleate, dioleate and trioleate.

According to another preferred embodiment, the compound (T2) is selected from monoester(s) and diester(s) of polyglycerols having from 2 to 10 glycerol units per molecule, preferably from 2 to 5 glycerol units per molecule, and mixtures thereof.

According to one preferred embodiment, the composition further comprises at least one detergent additive.

According to one preferred embodiment, the detergent additive is selected from succinimides, polyetheramines and quaternary ammonium salts.

According to one preferred embodiment, the detergent additive is selected from polyisobutylene succinimides and polyisobutylenes functionalized by a quaternary ammonium group.

According to one preferred embodiment, the composition comprises:

from 5 to 1000 ppm, preferably from 50 to 500 ppm, more preferentially still from 100 to 300 ppm of additive (T1), from 5 to 500 ppm, preferably from 25 to 200 ppm, more preferentially still from 50 to 100 ppm of additive (T2).

According to one preferred embodiment, the composition comprises:

from 5 to 1000 ppm, preferably from 50 to 500 ppm, more preferentially still from 100 to 300 ppm of additive (T1), from 5 to 500 ppm, preferably from 25 to 200 ppm, more preferentially still from 50 to 100 ppm of additive (T2), from 1 to 1000 ppm, more preferentially from 5 to 400 ppm of at least one detergent additive.

According to one preferred embodiment, the composition comprises:

from 5 to 1000 ppm, preferably from 50 to 500 ppm, more preferentially still from 100 to 300 ppm of additive (T1), from 5 to 500 ppm, preferably from 25 to 200 ppm, more preferentially still from 50 to 100 ppm of additive (T2), from 1 to 1000 ppm, more preferentially from 5 to 400 ppm of at least one detergent additive, at least 50 ppm of water, more preferentially still at least 100 ppm of water, better still at least 150 ppm of water.

According to one preferred embodiment, the (T1):(T2) weight ratio is from 10:1 to 1:10, preferentially from 10:1 to 1:1.

Another subject of the invention is a composition of fuel additives that is intended for a vehicle equipped with an internal combustion engine, and which comprises at least:

a compound (T1) selected from $C_1$-$C_6$ alkyl ethers of polyethylene glycol comprising two to six ethylene glycol units, preferably diethylene glycol methyl ether, a compound (T2) selected from esters of one or more $C_1$ to $C_{36}$, preferably $C_4$ to $C_{36}$ alkylcarboxylic or alkenylcarboxylic acids and of a polyol selected from sorbitan and isosorbide, taken alone or as a mixture, and optionally, a detergent additive, preferably a detergent additive comprising a quaternary ammonium function.

According to one preferred embodiment, the composition of additives comprises at least:

a compound (T1) which is diethylene glycol methyl ether, a compound (T2) selected from sorbitan partial esters, taken alone or as a mixture, and optionally, a detergent additive, preferably a detergent additive comprising a quaternary ammonium function.

Another subject of the invention is a process for formulating a fuel intended for a vehicle equipped with an internal combustion engine, comprising the additization of a fuel with at least one additive (T1) selected from: polyalkylene glycols and $C_1$-$C_{12}$ alkyl ethers of polyalkylene glycol, and at least one compound (T2) selected from nonionic emulsifiers.

According to one preferred embodiment of the process, the fuel is additized with at least one detergent additive.

According to one preferred embodiment of the process, the fuel comprises at least 50 ppm of water, more preferentially still at least 100 ppm of water, better still at least 150 ppm of water.

The invention also relates to the use of a composition of additives in a fuel intended for a vehicle equipped with an internal combustion engine, to prevent, avoid or delay the formation of ice crystals or flakes in said fuel, wherein the composition of additives comprises:

at least one additive (T1) selected from: polyalkylene glycols and $C_1$-$C_{12}$ alkyl ethers of polyalkylene glycol, and at least one compound (T2) selected from nonionic emulsifiers.

According to one preferred embodiment of the use, the fuel comprises at least 50 ppm of water, more preferentially still at least 100 ppm of water, better still at least 150 ppm of water.

DETAILED DESCRIPTION

The expression "consists essentially of" followed by one or more features means that, besides the components or steps explicitly listed, components or steps that do not significantly modify the properties and features of the invention may be included in the process or the material of the invention.

The expression "between X and Y" includes the limits, unless explicitly mentioned otherwise. This expression thus means that the targeted range comprises the values X, Y and all the values ranging from X to Y.

The term "flake" is understood to mean relatively large clusters visible to the eye that are formed from water. It is agreed that the use of the term "flake" in the description under no circumstances refers to flakes formed from compounds other than water, for example from paraffins.

The term "additive" is understood to mean a chemical substance, often liquid or powdered, which is in general introduced before or during the forming of the material, to provide or improve one or more specific properties. The incorporation by weight is low, generally less than 1% by weight at most, unlike a filler or a base. They may be used to obtain a positive effect in the production, storage or treatment phase, during and after the usage phase of the product.

Polyalkylene Glycol Compound (T1)

The polyalkylene glycol compound (T1) is selected from polyalkylene glycols and polyalkylene glycols functionalized at the chain end with an alkyl ether.

Among the polyalkylene glycols, mention may be made of polyethylene glycol and polypropylene glycol. Preferably, the invention relates to polyethylene glycol and polyethylene glycol derivatives functionalized at the chain end with an alkyl ether.

The functionalization at the chain end with an alkyl ether is advantageously selected from a $C_1$-$C_{12}$, preferentially $C_1$-$C_6$, even more advantageously $C_1$-$C_3$ alkyl ether.

The alkyl group at the chain end may be linear or branched. For example, mention may be made of a methyl, ethyl, n-propyl, isopropyl, n-butyl, isobutyl, tert-butyl, pentyl, hexyl, heptyl, octyl, nonyl, decyl, dodecyl group.

Preferably, the polyalkylene glycol compound (T1) is selected from ethylene glycol oligomers comprising from 2 to 20 ethylene glycol units and derivatives thereof functionalized at the chain end with an alkyl ether. Even more advantageously, it is selected from ethylene glycol oligomers comprising from 2 to 10 ethylene glycol units and derivatives thereof functionalized at the chain end with an alkyl ether. Better still, it is selected from ethylene glycol oligomers comprising from 2 to 6 ethylene glycol units and derivatives thereof functionalized at the chain end with an alkyl ether. Advantageously, it is selected from ethylene glycol oligomers comprising from 2 to 4 ethylene glycol units and derivatives thereof functionalized at the chain end with an alkyl ether. Preferably, it is selected from ethylene glycol oligomers comprising from 2 to 4 ethylene glycol units and derivatives thereof functionalized at the chain end with a $C_1$-$C_{12}$, preferentially $C_1$-$C_6$, even more advantageously $C_1$-$C_3$ alkyl ether.

Advantageously, the polyalkylene glycol compound (T1) is diethylene glycol methyl ether.

The amount of additive (T1) in the fuel composition is advantageously from 5 to 1000 ppm, preferably from 50 to 500 ppm, more preferentially still from 100 to 300 ppm.

Nonionic Emulsifiers (T2)

The composition according to the invention further comprises a compound (T2) selected from nonionic emulsifiers.

Among the nonionic emulsifiers that can be used in the invention, mention may in particular be made of polyol esters of $C_1$ to $C_{36}$, preferably $C_4$-$C_{30}$, more preferentially $C_{12}$-$C_{24}$, more preferentially $C_{16}$-$C_{20}$ monocarboxylic aliphatic hydrocarbons, it being possible for said esters to be taken alone or as a mixture.

A $C_1$ to $C_{36}$ monocarboxylic aliphatic hydrocarbon is understood to mean a linear or branched, cyclic or acyclic alkyl or alkenyl chain, optionally comprising more than one unsaturation and comprising a —COOH carboxylic acid function.

Preferably, the compound (T2) is selected from partial esters of polyols and of monocarboxylic aliphatic hydrocarbons.

A partial ester of a polyol is understood to mean that some of the alcohol functions of the polyol are free, not esterified.

A partial ester of a polyol may be obtained by reacting an amount of monocarboxylic acid that is less than the amount needed to esterify all of the alcohol functions of the polyol.

A partial ester of a polyol may be obtained by stopping the esterification reaction before having esterified all of the alcohol functions of the polyol.

Preferably, the nonionic emulsifiers are selected from partial esters of $C_4$-$C_{20}$ polyols and of saturated or unsaturated, linear or branched, cyclic or acyclic $C_4$ to $C_{30}$, preferably $C_{12}$-$C_{24}$, more preferentially $C_{16}$-$C_{20}$ monocarboxylic aliphatic hydrocarbons, it being possible for said partial esters to be taken alone or as a mixture.

The compound (T2) comprises, preferably, x ester units, y hydroxyl units and z ether units, x, y and z being integers such that x varies from 1 to 10, y varies from 1 to 10, and z varies from 0 to 6.

According to one particular embodiment, x varies from 1 to 10, y varies from 3 to 10 and z varies from 0 to 6.

According to another particular embodiment, x varies from 1 to 4, y varies from 1 to 7 and z varies from 1 to 3. Advantageously, x varies from 2 to 4.

The synthesis of polyol esters, in particular of polyol partial esters, is known; they may for example be prepared by esterification of fatty acid(s) and of linear and/or branched polyols optionally comprising (hetero)cycles with 5 to 6 atoms supporting hydroxyl functions. Generally this type of synthesis leads to a mixture of monoesters, diesters, triesters and optionally tetraesters, and also small amounts of fatty acid(s) and polyols that have not reacted.

According to one particular embodiment, the compound (T2) is obtained by esterification reaction of one or more $C_1$ to $C_{36}$ acids, preferably of one or more $C_4$-$C_{30}$ acids, more preferentially still of one or more $C_{12}$-$C_{24}$, more preferentially $C_{16}$-$C_{20}$, fatty acid(s) optionally comprising one or more ethylenic bonds, and with at least one linear or branched, cyclic or acyclic $C_4$-$C_{20}$ polyol optionally comprising one or more heterocycles with 5 to 6 atoms, preferably one or more heterocycles with 4 to 5 carbon atoms and an oxygen atom, substituted by hydroxyl groups.

Preferably, the compound (T2) is a partial ester of one or more $C_1$ to $C_{36}$ acids, preferably of one or more $C_4$-$C_{30}$ acids, more preferentially still of one or more $C_{12}$-$C_{24}$, more preferentially $C_{16}$-$C_{20}$, fatty acid(s) optionally comprising one or more ethylenic bonds, and of at least one linear or branched, cyclic or acyclic $C_4$-$C_{20}$ polyol optionally comprising one or more heterocycles with 5 to 6 atoms, preferably one or more heterocycles with 4 to 5 carbon atoms and an oxygen atom, substituted by hydroxyl groups.

The fatty acids are, advantageously, selected from the group consisting of stearic, isostearic, linolenic, oleic, linoleic, behenic, arachidonic, ricinoleic, palmitic, myristic, lauric, capric acids, taken alone or as a mixture.

The fatty acids may originate from the transesterification or saponification of vegetable oils and/or of animal fats. The preferred vegetable oils and/or animal fats will be selected as a function of their concentration in oleic acid. Reference may for example be made to Table 6.21 from chapter 6 of the book "Carburants & Moteurs" [Fuels & Engines] by J. C. Guibet and E. Faure, 2007 edition, in which the compositions of several vegetable oils and animal fats are indicated.

The fatty acids may also originate from fatty acids derived from tall oil (Tall Oil Fatty Acids) which comprise a majority amount of fatty acids, typically greater than or equal to 90% by weight and also resin acids and unsaponifiable matter in a minority amount, i.e. in amounts in general of less than 10%.

The polyol is preferably selected from linear or branched $C_4$-$C_{20}$ polyols comprising at least three hydroxyl functions and polyols comprising at least one ring with 5 or 6 atoms, preferably a heterocycle with 4 to 5 carbon atoms and an oxygen atom, optionally substituted by hydroxyl groups, taken alone or as a mixture.

Advantageously, the polyol is selected from oxygenated $C_4$-$C_{20}$ hydrocarbon-based molecules comprising one or two heterocycles with 4 to 5 carbon atoms and an oxygen atom, and several hydroxyl groups.

According to a preferred variant, the polyol is selected from oxygenated $C_4$-$C_{20}$ hydrocarbon-based molecules comprising at least one ring with 5 or 6 atoms, preferably a heterocycle with 4 to 5 carbon atoms and an oxygen atom, optionally substituted by hydroxyl groups, taken alone or as a mixture.

According to another variant, the polyol is selected from oxygenated hydrocarbon-based molecules comprising at least two heterocycles with 4 or 5 carbon atoms and an oxygen atom, connected together by the formation of an acetal bond between a hydroxyl function of each cycle, said heterocycles optionally being substituted by hydroxyl groups.

The polyol is, in particular, selected from the group consisting of erythritol, xylitol, arabitol, ribitol, sorbitol, maltitol, isomaltitol, lactitol, volemitol, mannitol, pentaerythritol, 2-hydroxymethyl-1,3-propanediol, 1,1,1-tri(hydlroxymethyl)ethane, trimethylolpropane, sorbitan, isosorbide, and carbohydrates such as saccharose, fructose, maltose and glucose, preferably sorbitan and isosorbide.

According to one particular embodiment, the compound (T2) is selected from sorbitan esters.

Preferably, according to this particular embodiment, the compound (T2) is selected from sorbitan partial esters, preferably sorbitan diesters, monoesters and triesters, taken alone or as a mixture.

The sorbitan esters may be represented by the formula (I) below (I)

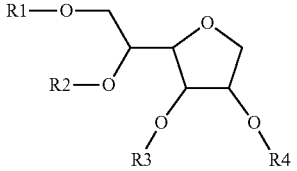

in which R1, R2, R3, R4 represent, independently, a hydrogen atom or a $C_1$-$C_{36}$, preferably $C_4$-$C_{30}$, advantageously $C_{12}$-$C_{24}$, more preferentially $C_{16}$-$C_{20}$ alkylcarboxylic or alkenylcarboxylic group, one at least of R1, R2, R3 and R4 being other than H.

According to another particular embodiment, the compound (T2) is selected from esters of monocarboxylic acids and isosorbides.

Advantageously, according to this particular embodiment, the compound (T2) is selected from partial esters of monocarboxylic acids and isosorbides, preferably isosorbide monoesters and mixtures thereof with isosorbide diesters.

The esters of monocarboxylic acids and isosorbides may be represented by the formula (II) below (II)

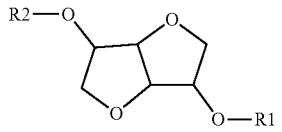

in which R1 and R2 represent, independently, a hydrogen atom or a $C_1$-$C_{36}$, preferably $C_4$-$C_{30}$, advantageously $C_{12}$-$C_{24}$, more preferentially $C_{16}$-$C_{20}$ alkylcarboxylic or alkenylcarboxylic group, one at least of R1 and R2 being other than H.

According to one variant, the compound (T2) is selected from sorbitan partial esters comprising more than 40% by weight of sorbitan triesters, preferably more than 50% by weight.

According to another variant, the compound (T2) is selected from sorbitan partial esters comprising more than 20% by weight of sorbitan monoesters and/or more than 20% by weight of sorbitan diesters, preferably more than 20% by weight of sorbitan monoesters and/or more than 30% by weight of sorbitan diesters, more preferentially more than 25% by weight of sorbitan monoesters and/or more than 35% by weight of sorbitan diesters.

According to another particular embodiment of the invention, the compound (T2) is selected from polyglycerol monoester(s) and/or diester(s) derived from fatty acid(s), advantageously from the compounds comprising 2 to 10 glycerol units, more advantageously still from 2 to 5 glycerol units.

As examples of polyglycerol esters, mention may be made of polyglycerol polyricinoleate (composed of polyglycerol esters of fatty acids condensed from castor oil), or polyglycerol esters of dimerized soybean oil fatty acids.

According to this variant, advantageously, the compound (T2) is selected from polyglycerol monoester(s) and/or diester(s) derived from fatty acid(s) having more than 50% by number of the fatty chains comprising between 12 and 24 carbon atoms. Such polyglycerols have been described in document WO 2013/120985.

According to this variant, the compound (T2) is, preferably, selected from diglycerol and/or triglycerol monoester(s) and/or diester(s).

In particular according to one preferred variant, the diglycerol and/or triglycerol partial esters comprise:

- at least 50% by weight of monoester(s) and/or diester(s) of oleic acid and of diglycerol, therefore of diglycerol monooleate(s) (DGMO) and/or of diglycerol dioleate(s) (DGDO), or
- at least 50% by weight of monoester(s) and/or diester(s) of oleic acid and of triglycerol, therefore of triglycerol monooleate(s) (TGMO) and/or of triglycerol dioleate(s), or
- at least 50% by weight of monoester(s) and/or diester(s) of oleic acid and of diglycerol and/or of triglycerol.

The amount of additive (T2) in the fuel composition is advantageously from 5 to 500 ppm, preferably from 25 to 200 ppm, more preferentially still from 50 to 100 ppm.

Fuel

The liquid fuel is advantageously derived from one or more sources selected from the group consisting of mineral, animal, vegetable and synthetic sources. Oil will preferably be selected as mineral source.

The liquid fuel is, preferably, selected from hydrocarbon-based fuels and fuels that are not essentially hydrocarbon-based, alone or as a mixture.

The term "hydrocarbon-based fuel" means a fuel consisting of one or more compounds consisting solely of carbon and hydrogen.

The term "fuel not essentially hydrocarbon-based" means a fuel consisting of one or more compounds not essentially consisting of carbon and hydrogen, i.e. which also contain other atoms, in particular oxygen atoms.

The hydrocarbon-based fuels especially comprise middle distillates with a boiling point ranging from 100 to 500° C. or lighter distillates with a boiling point in the gasoline range. These distillates may be chosen, for example, from the distillates obtained by direct distillation of crude hydrocarbons, vacuum distillates, hydrotreated distillates, distillates derived from the catalytic cracking and/or hydrocracking of vacuum distillates, distillates resulting from conversion processes such as ARDS (atmospheric residue desulfurization) and/or visbreaking, and distillates derived from the upgrading of Fischer-Tropsch cuts. The hydrocarbon-based fuels are typically gasolines and diesel fuels.

Gasolines in particular comprise all commercially available fuel compositions for spark ignition engines. A representative example that may be mentioned is the gasolines corresponding to standard NF EN 228. Gasolines generally have octane numbers that are high enough to avoid pinking. Typically, the fuels of gasoline type sold in Europe, in accordance with standard NF EN 228, have a motor octane number (MON) of greater than 85 and a research octane number (RON) of at least 95. Fuels of gasoline type generally have an RON ranging from 90 to 100 and an MON ranging from 80 to 90, the RON and MON being measured according to standard ASTM D 2699-86 or D 2700-86.

Diesel fuels in particular comprise all commercially available fuel compositions for diesel internal combustion engines. A representative example that may be mentioned is the diesel fuels corresponding to standard NF EN 590.

Fuels that are not essentially hydrocarbon-based especially comprise oxygenated fuels, for example distillates resulting from the BTL (biomass to liquid) conversion of vegetable and/or animal biomass, taken alone or in combination; biofuels, for example vegetable and/or animal oils and/or vegetable and/or animal oil esters; biodiesels of animal and/or vegetable origin and bioethanols.

The mixtures of hydrocarbon-based fuel and of fuel that is not essentially hydrocarbon-based are typically diesel fuels of $B_x$ type or gasolines of $E_x$ type.

The term "diesel fuel of $B_x$ type for diesel internal combustion engine" means a diesel fuel which contains x % (v/v) of vegetable or animal oil esters (including used cooking oils) transformed via a chemical process known as transesterification, obtained by reacting this oil with an alcohol so as to obtain fatty acid esters (FAE). With methanol and ethanol, fatty acid methyl esters (FAME) and fatty acid ethyl esters (FAEE) are obtained, respectively. The letter "B" followed by a number indicates the percentage of FAE contained in the diesel fuel. Thus, a B99 contains 99% of FAE and 1% of middle distillates of fossil origin (mineral source), B20 contains 20% of FAE and 80% of middle distillates of fossil origin, etc. Diesel fuels of $B_0$ type which do not contain any oxygenated compounds are thus distinguished from diesel fuels of $B_x$ type which contain x % (v/v) of vegetable oil esters or of fatty acid esters, usually methyl esters (VOME or FAME). When the FAE is used alone in engines, the fuel is designated by the term B100.

The term "gasoline of $E_x$ type for spark ignition engine" means a gasoline fuel which contains x % (v/v) of oxygenated compounds, generally ethanol, bioethanol and/or tert-butyl ethyl ether (TBEE).

The sulfur content of the liquid fuel is preferably less than or equal to 5000 ppm, preferably less than or equal to 500 ppm and more preferentially less than or equal to 50 ppm, or even less than or equal to 10 ppm and advantageously sulfur-free.

Advantageously, the fuel is selected from the fuels as described above with the exception of fuels comprising or consisting of kerosene typically having an initial boiling point (IBP) between 150° C. and 180° C., and an end boiling point (EBP) between 225° C. and 250° C. More preferentially, aviation fuels are excluded from the invention.

Advantageously, the fuel comprises at least 50% by weight of a diesel fuel, preferably at least 70% by weight, more preferentially at least 90% by weight relative to the total weight of fuel. More preferentially still, the fuel consists of diesel fuel.

The invention applies more particularly to diesel fuels.

More specifically, it relates to diesel fuels comprising no alcohol.

More specifically, it relates to diesel fuels comprising no FAME or FAEE.

Advantageously, it relates to $B_0$ diesel fuels.

The invention relates more particularly to fuels containing water, in particular fuels having a water content of at least 50 ppm, preferentially at least 100 ppm; it is particularly noteworthy for the treatment of fuels having a water content of at least 150 ppm.

The invention relates more specifically to diesel fuels containing water, in particular diesel fuels having a water content of at least 50 ppm, preferentially at least 100 ppm; it is particularly noteworthy for the treatment of diesel fuels having a water content of at least 150 ppm.

It is understood that the water content is evaluated during the formulation of the fuel with the composition of additives according to the invention. It is known that the weight content of water may increase during the storage and transportation of the fuel. Thus, a fuel having at least 50 ppm of water originally may exhibit problems of appearance of flakes depending on its transportation or storage conditions.

Detergent Additives

The term "detergent additive for liquid fuel" means an additive which is incorporated in a small amount into the liquid fuel and produces an effect on the cleanliness of said engine when compared with said liquid fuel not specially additized.

Detergent additives for fuels intended for vehicles equipped with an internal combustion engine are well known and widely described in the literature. Mention may in particular be made of: the group consisting of succinimides, polyetheramines and quaternary ammonium salts; for example those described in documents U.S. Pat. No. 4,171,959 (quaternary ammonium salts of succinimides) and WO 2006/135881 (quaternary ammonium salts).

According to a first advantageous embodiment, the detergent additive is selected from N-substituted alkenylsuccinimides. N-substituted alkenylsuccinim ides customarily comprise a long chain and have a variety of chemical structures, and in particular they may be selected from a monosuccinimide or a disuccinimide. Often the long-chain alkenyl group has a number-average molecular mass of from 350 to 10 000, preferably from 400 to 7000, more preferentially still from 500 to 5000 and better still from 500 to 4000. In one embodiment, the long-chain alkenyl group is a polyisobutylene group, which has a number-average molecular mass of from 200 to 4000 and preferably from 800 to 3000, more preferentially from 1000 to 2000. The N-substituted alkenyl long-chain dispersant additives and the preparation thereof are described, for example, in documents U.S. Pat. Nos. 3,361,673, 3,401,118 and 4,234,435. According to a second advantageous embodiment, the detergent additive is selected from quaternary ammonium salts as described in WO 2006/135881 and in WO 2015/124575, in particular quaternary ammonium salts of polyisobutylene.

The detergent additive is incorporated, preferably, in a small amount in the liquid fuel described above, the amount of detergent being sufficient to produce a detergent effect as described above and to thus improve engine cleanliness.

The fuel composition advantageously comprises from 1 to 1000 ppm, preferably from 5 to 400 ppm, of at least one detergent.

Other Additives

Besides the detergents described above, the fuel composition may also comprise one or more other additives, different from the compounds (T1) and (T2) according to the invention, and selected for example from corrosion inhibitors, dispersants, biocides, reodorants, cetane boosters, friction modifiers, lubricity additives or oiliness additives, combustion promoters (catalytic combustion and soot promoters), agents for improving the cloud point, the pour point or the CFPP (cold filter plugging point), anti-settling agents, anti-wear agents and/or conductivity modifiers.

Among these additives, mention may in particular be made of:

a) cetane boosters, in particular (but nonlimitingly) selected from alkyl nitrates, preferably 2-ethylhexyl nitrate, aryl peroxides, preferably benzyl peroxide, and alkyl peroxides, preferably tert-butyl peroxide;

b) cold flow improvers (CFI) selected from the ethylene/unsaturated ester copolymers, such as ethylene/vinyl acetate (EVA), ethylene/vinyl propionate (EVP), ethylene/vinyl ethanoate (EVE), ethylene/methyl methacrylate (EMMA), and ethylene/alkyl fumarate copolymers described, for example, in documents U.S. Pat. Nos. 3,048,479, 3,627,838, 3,790,359, 3,961,961 and EP 261 957;

c) lubricity additives or anti-wear agents, in particular (but nonlimitingly) selected from the group consisting of fatty acids;

d) cloud point additives, in particular (but nonlimitingly) selected from the group consisting of long-chain olefin/(meth)acrylic ester/maleimide terpolymers, and polymers of esters of fumaric/maleic acids. Examples of such additives are given in FR 2528051, FR 2528423, EP 112 195, EP 172 758, EP 271 385, EP 291 367;

e) polyfunctional additives for cold operability selected from the group consisting of polymers based on olefin and alkenyl nitrate as described in EP 573 490.

These other additives are in general added in an amount ranging from 100 to 1000 ppm each.

Fuel Composition

Advantageously, the additized fuel composition comprises:

- a compound (T1) selected from $C_1$-$C_6$ alkyl ethers of polyethylene glycol comprising two to six ethylene glycol units,
- a compound (T2) selected from esters of one or more $C_1$ to $C_{36}$ alkylcarboxylic or alkenylcarboxylic acids and of at least one $C_4$-$C_{20}$ polyol optionally comprising one or more heterocycles with 5 to 6 atoms, preferably one or two heterocycles with 4 to 5 carbon atoms and an oxygen atom, and optionally a detergent additive.

More advantageously still, the additized fuel composition comprises:

- a compound (T1) selected from $C_1$-$C_6$ alkyl ethers of polyethylene glycol comprising two to six ethylene glycol units,
- a compound (T2) selected from esters of one or more $C_4$ to $C_{30}$ alkylcarboxylic or alkenylcarboxylic acids and of at least one $C_4$-$C_{20}$ polyol optionally comprising one or more heterocycles with 5 to 6 atoms, preferably one or two heterocycles with 4 to 5 carbon atoms and an oxygen atom, and optionally a detergent additive.

More advantageously still, the additized fuel composition comprises:

- a compound (T1) which is diethylene glycol methyl ether,
- a compound (T2) selected from partial esters of one or more $C_{12}$ to $C_{24}$ alkylcarboxylic or alkenylcarboxylic acids and of at least one polyol selected from sorbitan and isosorbide, and optionally a detergent additive.

According to one more preferred embodiment, the additized fuel composition comprises:

- a compound (T1) which is diethylene glycol methyl ether,
- a compound (T2) selected from mixtures of partial esters of one or more $C_{12}$ to $C_{24}$ alkylcarboxylic or alkenylcarboxylic acids and of sorbitan, preferably mixtures of sorbitan monooleate, dioleate and trioleate, and optionally a detergent additive.

Advantageously, the additized fuel composition comprises:

- from 5 to 1000 ppm, preferably from 50 to 500 ppm, more preferentially still from 100 to 300 ppm of additive (T1),
- from 5 to 500 ppm, preferably from 25 to 200 ppm, more preferentially still from 50 to 100 ppm of additive (T2).

More advantageously still, the additized fuel composition comprises, or, better still, consists essentially of:

- from 5 to 1000 ppm, preferably from 50 to 500 ppm, more preferentially still from 100 to 300 ppm of additive (T1),
- from 5 to 500 ppm, preferably from 25 to 200 ppm, more preferentially still from 50 to 100 ppm of additive (T2),
- from 1 to 1000 ppm, more preferentially from 5 to 200 ppm of at least one detergent additive.

According to one preferred embodiment, the additized fuel composition comprises, or, better still, consists essentially of:

- from 5 to 1000 ppm, preferably from 50 to 500 ppm, more preferentially still from 100 to 300 ppm of additive (T1), from 5 to 500 ppm, preferably from 25 to 200 ppm, more preferentially still from 50 to 100 ppm of additive (T2), from 1 to 1000 ppm, more preferentially from 5 to 200 ppm of at least one detergent additive, at least 50 ppm of water, more preferentially still at least 100 ppm of water, better still at least 150 ppm of water.

Advantageously, the (T1):(T2) weight ratio is from 10:1 to 1:10, more preferentially from 10:1 to 1:1.

Composition of Fuel Additives

According to one particular embodiment, the mixture of the compounds (T1) and (T2) is used in the form of an additive concentrate, optionally in combination with at least one other internal combustion engine fuel additive different from (T1) and (T2).

The additive concentrate may, typically, comprise one or more other additives selected from detergent additives or others which have been described above.

The composition of fuel additives may be used to formulate a fuel composition. It comprises at least:

a compound (T1) selected from $C_1$-$C_6$ alkyl ethers of polyethylene glycol comprising two to six ethylene glycol units, preferably diethylene glycol methyl ether, a compound (T2) selected from esters of one or more $C_1$ to $C_{36}$ alkylcarboxylic or alkenylcarboxylic acids and of a polyol selected from sorbitan and isosorbide, taken alone or as a mixture, and optionally, a detergent additive.

Preferably, the alkylcarboxylic or alkenylcarboxylic acid(s) are selected from $C_4$ to $C_{36}$, more preferentially still $C_{12}$-$C_{24}$ and advantageously $C_{16}$-$C_{20}$ alkylcarboxylic or alkenylcarboxylic acids.

Advantageously, the additive concentrate comprises at least:

a compound (T1) which is diethylene glycol methyl ether, a compound (T2) selected from partial sorbitan esters, taken alone or as a mixture, and optionally, a detergent additive.

Preferably, the detergent additive is selected from succinimides, polyetheramines and quaternary ammonium salts, advantageously from those comprising a quaternary ammonium function.

Advantageously, in the additive composition, the (T1):(T2) weight ratio is from 10:1 to 1:10, more preferentially from 10:1 to 1:1.

The additive composition is advantageously used in the fuel composition in a content ranging from 5 to 5000 ppm, advantageously from 10 to 1000 ppm, better still from 20 to 500 ppm.

Process

Another subject of the invention is a process for formulating a fuel intended for a vehicle equipped with an internal combustion engine, comprising the additization of a fuel with at least one additive (T1) selected from: polyalkylene glycols and $C_1$-$C_{12}$ alkyl ethers of polyalkylene glycol, and at least one compound (T2) selected from nonionic emulsifiers.

The preferences described above for the compounds (T1) and (T2) also apply to the process.

Advantageously, the process comprises the additization of from 5 to 1000 ppm, preferably from 50 to 500 ppm, more preferentially still from 100 to 300 ppm of additive (T1), and of from 5 to 500 ppm, preferably from 25 to 200 ppm, more preferentially still from 50 to 100 ppm of additive (T2).

Preferably, the process for formulating a fuel further comprises the additization with at least one detergent additive.

The preferences described above for the detergent additives also apply to the process.

Advantageously, the process comprises the additization of:

from 5 to 1000 ppm, preferably from 50 to 500 ppm, more preferentially still from 100 to 300 ppm of additive (T1), from 5 to 500 ppm, preferably from 25 to 200 ppm, more preferentially still from 50 to 100 ppm of additive (T2), from 1 to 1000 ppm, more preferentially from 5 to 200 ppm of at least one detergent additive.

The process of the invention is advantageously carried out in order to prevent, avoid or delay the formation of ice crystals or flakes in a fuel of a vehicle equipped with an internal combustion engine, this process comprising at least the following steps:

the preparation of a fuel composition by additization of a fuel with at least one additive (T1) and at least one additive (T2) as described above.

This process makes it possible to avoid the formation of ice in fuels, in particular in diesel fuels, at a temperature less than or equal to −15° C., and preferably at a temperature less than or equal to −25° C.

This process relates more particularly to fuels comprising at least 50 ppm of water, more preferentially still at least 100 ppm of water, better still at least 150 ppm of water.

This process is particularly useful in countries like Russia where monitoring of the quality of the fuels is limited, the presence of water is common, and where the temperatures drop below zero for prolonged periods, from several weeks to several months.

The invention also relates to the use of at least one additive (T1) and at least one additive (T2) as described above, for avoiding the formation of ice in fuels, in particular in diesel fuels, at a temperature less than or equal to −15° C., and preferably at a temperature less than or equal to −25° C.

Furthermore, the invention relates more particularly to fuel compositions further comprising at least one detergent additive intended to maintain or restore the cleanliness of the engine.

Methods for evaluating the detergent properties of fuels have largely been described in the literature and fall within the general knowledge of a person skilled in the art. Non-limiting examples that will be mentioned include the tests standardized or recognized by the profession or the following methods described in the literature:

For direct-injection diesel internal combustion engines:

the DW10 method, standardized engine test method CEC F-98-08, for measuring the power loss of direct-injection diesel engines the XUD9 method, standardized engine test method CEC F-23-1-01 Issue 5, for measuring the restriction of fuel flow emitted by the injector the method described by the applicant in application WO 2014/029770, pages 17 to 20, for the evaluation of lacquering deposits (IDID), this method being cited by way of example and/or incorporated by reference into the present application.

For indirect-injection spark ignition engines:

the Mercedes Benz M102E method, standardized test method CEC F-05-A-93, and the Mercedes Benz M111 method, standardized test method CEC F-20-A-98.

These methods make it possible to measure the intake valve deposits (IVD), the tests generally being performed on a Eurosuper gasoline corresponding to standard EN228.

For direct-injection spark ignition engines:

the method described by the applicant in the article "Evaluating Injector Fouling in Direct Injection Spark Ignition Engines", Mathieu Arondel, Philippe China, Julien Gueit; Conventional and future energy for automobiles; 10th international colloquium; Jan. 20-22, 2015, p. 375-386 (Technische Akademie Esslingen par Techn. Akad. Esslingen, Ostfildern), for the evaluation of the coking deposits on the injector, this method being cited by way of example and/or incorporated by reference into the present application.

the method described in US 2013/0104826 for the evaluation of the coking deposits on the injector, this method being cited by way of example and/or incorporated by reference into the present application.

The determination of the amount of detergent to be added to the fuel composition to achieve the specification will be carried out typically by comparison with the fuel composition not containing the detergent, the specification given relative to the detergency possibly being, for example, a target power loss value according to the method DW10 or a flow restriction value according to the method XUD9 mentioned above.

The amount of detergent may also vary as a function of the nature and origin of the fuel, in particular as a function of the content of compounds bearing n-alkyl, isoalkyl or n-alkenyl substituents. Thus, the nature and origin of the fuel may also be a factor to be taken into consideration.

The process for maintaining the cleanliness and/or for cleaning may also comprise an additional step of checking the target reached and/or of adjusting the amount of additization with the detergent additive(s).

Experimental Section

1—Materials and Method:

A—Raw Materials:

Fuel: the additives were tested on a Diesel GO fuel, the characteristics of which are described in table 1 below.

Detergent:

a polyisobutylene succinimide sold by TOTAL under the name TOTAL PIBSI.

Nonionic Emulsifier:

a mixture of sorbitan esters predominantly comprising sorbitan trioleate sold by the company Oleon under the brand Radiasurf 7348®.

Solvent: an aromatic solvent sold under the name Solvarex 10® was used.

Deicing Agent:

diethylene glycol methyl ether sold by the company Nyco Defence under the brand Nycosol 13 ®, or 99.6% 2-ethylhexanol (EHA) sold by the company Sigma Aldrich.

TABLE 1

Characteristics of the Diesel GO evaluated according to the standard DT-W-K5 minus 32 according to GOST R 55475-2013

| | GO winter diesel fuel | Unit |
|---|---|---|
| Cold filter plugging point | <−32 | ° C. |
| Cloud point | <−22 | ° C. |
| Polyaromatics | <8.0 | % w |
| Flash point | >40 | ° C. |
| Density at 15° C. | 800-855 | kg/m$^3$ |

TABLE 1-continued

Characteristics of the Diesel GO evaluated according to the standard DT-W-K5 minus 32 according to GOST R 55475-2013

| | GO winter diesel fuel | Unit |
|---|---|---|
| Lubricity | <460 | μm |
| Cetane number | >48.0 | Pt |
| Sulfur content | <10 | mg/kg |
| VOME content | /// | % vol |
| Water content | 43 | mg/kg |
| Distillation | | |
| E180 180° C. | <10 | % vol |
| E250 250° C. | | % vol |
| E350 350° C. | | % vol |
| T95 95% | <360 | ° C. |

B—Characterization Method:

Visual Test on the Appearance of Crystals with Characterization of Shape and Number:

The fuel composition was left at −15° C. for 12 h then at −25° C. for an additional 12 h. Next, the amount of crystals and their size were evaluated at each temperature hold after a light manual stirring of the flask (the use of a stirrer bar in the bottom of the flask may be useful) The gradings are explained in table 2 below.

TABLE 2 criteria for evaluating ice crystals by visual test

| | Grade | Meaning |
|---|---|---|
| Amount of crystals | 1 | Just one |
| | 2 | Few |
| | 3 | Many |
| Size of the crystals | a | Small |
| | b | Medium |
| | c | Large |

XUD9 Engine Test—Evaluation of the Detergent Properties:

The tests are performed on a Peugeot engine of XUD9 type (displacement of 1.9 L) according to the standardized test CEC F23-01.

The fuel used is the CEC DF79 reference fuel.

The test consists in measuring the injector flow loss after 10 h of engine operation with the fuel to be tested.

Completely fouled injectors result, according to this test, in a measured flow loss of 100% whereas clean (or new) injectors result in a measured flow loss of 0%.

2—Visual Test on the Appearance of Crystals in Various Fuel Compositions:

A—Compositions:

Use was made of a composition of commercial detergent additive A1 and a composition of commercial detergent additive A2, the characteristics of which are reported in table 3 below. The contents are given in % by weight of commercial product relative to the total weight of the composition.

TABLE 3

| Formulation of the detergent additive compositions | | | |
|---|---|---|---|
| | Trade name | A1 | A2 |
| Detergent Additive | TOTAL PIBSI (*) | 64.6 | 100 |
| Solvent | Solvarex 10 ® | 35.4 | — |

(*) active material at 50% by weight in a solvent

The detergent additive A1 composition was used to formulate the fuel compositions C1 to C3 given in table 4 below, using the Diesel GO fuel, the composition C0 is the control. The contents are given in ppm by weight. Examples C1 and C2 are comparative, example C3 is according to the invention.

TABLE 4

| Formulation of the additized fuels C0, C1, C2 and C3 | | | | | |
|---|---|---|---|---|---|
| | | Fuel composition | | | |
| | | C0 | C1 | C2 | C3 |
| Fuel | Water content | 150 | 150 | 150 | 150 |
| Detergent additive composition | A1 | — | 302 | 302 | 302 |
| Deicing agent | Nycosol 13 ® | — | — | — | 200 |
| | EHA | — | — | 200 | — |
| Nonionic emulsifier | Radiasurf 7348 ® | — | — | 65 | 65 |

The detergent additive A2 composition was used to formulate the fuel compositions C1' to C4' given in table 5 below, using the Diesel GO fuel, the composition C0' is the control. The contents are given in ppm by weight. Examples C1', C2' and C4' are comparative, example C3' is according to the invention.

TABLE 5

| Formulation of the additized fuels C0', C1', C2', C3' and C4' | | | | | | |
|---|---|---|---|---|---|---|
| Fuel composition | | C0' | C1' | C2' | C3' | C4' |
| Fuel | Water content | 180 | 180 | 180 | 180 | 180 |
| Detergent additive composition | A2 | — | 60 | 60 | 60 | 60 |
| Deicing agent | Nycosol 13 ® | — | — | — | 25 | 85 |
| Nonionic emulsifier | Radiasurf 7348 ® | — | — | 85 | 60 | 0 |

B—Results:

Compositions C0 to C3

The results of the tests carried out on compositions C0 to C3 are reported in table 6 below.

TABLE 6

| Results of the visual tests on compositions C0 to C3 | | |
|---|---|---|
| | Test at −15° C. for 12 h | Test at −25° C. for 12 h |
| C0 | 2a/1b | 2a/1b |
| C1 | 2a/1b | 1a/2b |
| C2 | 1a | 1a/2b/1c |
| C3 | 1a | 1a/1b |

It is observed that composition C1, which comprises only the detergent additive, forms ice crystals when it is exposed to the cold. In particular, at −25° C., the presence of the detergent additive favors the formation of ice crystals compared to the virgin diesel fuel C0.

It is observed that composition C2 is not effective at −25° C.

Only composition C3 according to the invention solves the problem of formation of ice crystals at −15° C. and −25° C.

Compositions C0' to C4'

The results of the tests carried out on compositions C0' to C4' are reported in table 7 below.

TABLE 7

| Results of the visual tests on compositions C0' to C4' | | |
|---|---|---|
| | Test at −15° C. for 12 h | Test at −25° C. for 12 h |
| C0' | 1a/1b | 2a/1b |
| C1' | 2a/1b | 2a/2b |
| C2' | 1a/1b | 2a/1b/1c |
| C3' | 1a/1b | 2a/1b |
| C4' | 1a/1b | 2a/3b/1c |

It is observed that composition C1', which comprises only the detergent additive, forms ice crystals when it is exposed to the cold. In particular, at −25° C., the presence of the detergent additive favors the formation of ice crystals compared to the virgin diesel fuel C0'.

It is observed that compositions C2' and C4' are not effective at −25° C.

Only composition C3' according to the invention solves the problem of formation of ice crystals at −15° C. and −25° C.

3—XUD9 Ermine Tests (CEC F23-01):

A—Fuel Compositions

The compositions C0", C1" and C3" listed in table 8 below were tested according to the protocol described above (1-B—).

TABLE 8

| Formulation of the additized fuels C0", C1" and C3" | | | | |
|---|---|---|---|---|
| | | Fuel composition | | |
| | | C0" | C1" | C3" |
| Fuel base | | CEC DF79 | CEC DF79 | CEC DF79 |
| Detergent additive composition | A2 | — | 60 | 60 |
| Deicing agent | Nycosol 13 ® | — | — | 25 |
| Nonionic emulsifier | Radiasurf 7348 ® | — | — | 60 |

B—Results

The results of the engine tests carried out on compositions C0", C1" and C3" are given in table 9 below:

TABLE 9

| Results of flow loss | | | |
|---|---|---|---|
| | Fuel composition | | |
| | C0" | C1" | C3" |
| Injector flow loss (%) at 0.1 mm needle lift | 75.4%* | 42.8% | 42.9% |

*Average of 2 tests: 75.7% and 75.0%.

The fuel compositions C1" and C3" make it possible to improve the properties of the fuel by reducing the fouling of the injectors.

However, only composition C3" according to the invention makes it possible to keep the engine clean while minimizing the formation of ice crystals at low temperature in the diesel fuel containing water.

The composition of additives and the fuel compositions according to the invention are particularly effective in so far as they solve the problem of appearance of ice crystals at low temperature while avoiding the degradation of the other properties of the fuel such as for example the anticorrosion or engine cleanliness properties.

The invention claimed is:

1. A fuel composition that comprises at least:

a fuel derived from one or more sources selected from the group consisting of mineral, animal, vegetable and synthetic sources, from 5 to 1000 ppm of a compound (T1) selected from: polyalkylene glycols, $C_1$-$C_{12}$ alkyl ethers of polyalkylene glycol, and mixtures thereof, from 5 to 500 ppm of a compound (T2) selected from nonionic emulsifiers, wherein the (T1):(T2) weight ratio is from 10:1 to 1:10.

2. The fuel composition as claimed in claim 1, wherein the fuel comprises at least 50% by weight of a diesel fuel relative to the total weight of fuel.

3. The fuel composition as claimed in claim 1, wherein the fuel comprises at least 50 ppm of water.

4. The fuel composition as claimed in claim 1, wherein the compound (T1) is selected from polyethylene glycols, $C_1$-$C_{12}$ alkyl ethers of polyethylene glycol, and mixtures thereof.

5. The fuel composition as claimed in claim 4, wherein the compound (T1) is selected from $C_1$-$C_6$ alkyl ethers of polyethylene glycol comprising two to six ethylene glycol units.

6. The fuel composition as claimed in claim 1, wherein the compound (T2) is selected from polyol esters of saturated or unsaturated, linear or branched, cyclic or acyclic $C_1$ to $C_{36}$, monocarboxylic aliphatic hydrocarbons, it being possible for said esters to be taken alone or as a mixture.

7. The fuel composition as claimed in claim 6, wherein the compound (T2) is obtained by esterification between:

one or more $C_1$ to $C_{36}$ alkylcarboxylic or alkenylcarboxylic acids, optionally comprising one or more ethylenic bonds; and a linear or branched, cyclic or acyclic $C_4$-$C_{20}$ polyol optionally comprising one or more heterocycles with 5 to 6 atoms.

8. The fuel composition as claimed in claim 7, wherein the alkylcarboxylic and alkenylcarboxylic acids are selected from the group consisting of stearic, isostearic, linolenic, oleic, linoleic, behenic, arachidonic, ricinoleic, palmitic, myristic, lauric, capric acids, taken alone or as a mixture.

9. The fuel composition as claimed in claim 6, wherein the polyol is selected from the group consisting of erythritol, xylitol, arabitol, ribitol, sorbitol, maltitol, isomaltitol, lactitol, volemitol, mannitol, pentaerythritol, 2-hydroxymethyl-1,3-propanediol, 1,1,1-tri(hydroxymethyl)ethane, trimethylolpropane, sorbitan, isosorbide, and carbohydrates such as saccharose, fructose, maltose and glucose.

10. The fuel composition as claimed in claim 9, wherein the compound (T2) is selected from sorbitan esters and isosorbide esters, taken alone or as a mixture.

11. The fuel composition as claimed in claim 1, wherein the compound (T2) is selected from monoester(s) and diester(s) of polyglycerols having from 2 to 10 glycerol units per molecule, and mixtures thereof.

12. The fuel composition as claimed in claim 1, which further comprises at least one detergent additive.

13. The fuel composition as claimed in claim 12, wherein the detergent additive is selected from succinimides, polyetheramines and quaternary ammonium salts.

14. The fuel composition as claimed in claim 1, further comprising:

from 1 to 1000 ppm of at least one detergent additive.

15. The fuel composition as claimed in claim 14, further comprising:

at least 50 ppm of water.

16. A method to prevent, avoid or delay the formation of ice crystals or flakes in a fuel composition intended for a vehicle equipped with an internal combustion engine, wherein the method comprises adding additives to a fuel, such that, after the addition of the additives, the fuel comprises:

from 5 to 1000 ppm of at least one additive (T1) selected from: polyalkylene glycols and $C_1$-$C_{12}$ alkyl ethers of polyalkylene glycol, and from 5 to 500 ppm of at least one compound (T2) selected from nonionic emulsifiers wherein the (T1):(T2) weight ratio is from 10:1 to 1:10.

17. The method as claimed in claim 16, wherein the fuel composition comprises at least 50 ppm of water.

18. The method as claimed in claim 16, wherein the compounds (T1) and (T2) are added in the form of an additive concentrate.

19. The method as claimed in claim 16, wherein the method further comprises an addition of at least one detergent additive.

* * * * *